US006619914B2

(12) United States Patent
Yokoyama et al.

(10) Patent No.: US 6,619,914 B2
(45) Date of Patent: Sep. 16, 2003

(54) CENTRIFUGAL FAN RUNNER AND AIR CLEANER

(75) Inventors: Makoto Yokoyama, Toyosaka (JP); Yoshihiro Takada, Chiyoda (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/102,744

(22) Filed: Mar. 22, 2002

(65) Prior Publication Data

US 2002/0098085 A1 Jul. 25, 2002

Related U.S. Application Data

(63) Continuation of application No. 09/817,219, filed on Mar. 27, 2001.

(30) Foreign Application Priority Data

Mar. 27, 2000 (JP) ..... 2000-090681

(51) Int. Cl.[7] ..... F04D 29/70

(52) U.S. Cl. ..... 415/121.2; 415/208.3

(58) Field of Search ..... 415/121.2, 208.3; 416/186 R, 238; 55/471; 413/121.2, 208.3

(56) References Cited

U.S. PATENT DOCUMENTS 5,188,508 A 2/1993 Scott et al. ..... 415/206
6,156,090 A 12/2000 Ishikawa ..... 55/471

*Primary Examiner*—Edward K. Look
*Assistant Examiner*—Kimya N McCoy
(74) *Attorney, Agent, or Firm*—Antonelli, Terry, Stout & Kraus, LLP

(57) ABSTRACT

An air cleaner includes a centrifugal fan runner equipped with backward blades, a core plate connected to an axis of a motor; and a side plate being opposing the core plate. The backward blades, being inclined in an anti-rotational direction thereof, are provided at a distance in a circumferential direction, and the backward blades are bent in a position at distance of about ½–1/(3.5) of a length of the blade from an outer periphery thereof, so that an outlet portion thereof is inclined into a direction of rotation of the blade. An outlet angle of the outlet portion with respect to a tangential direction on an outer periphery of said side plate lies from about 40 degree to about 60 degree.

3 Claims, 5 Drawing Sheets

CENTRIFUGAL FAN RUNNER AND AIR CLEANER

This is a continuation application of application Ser. No. 09/817,219, filed Mar. 27, 2001.

BACKGROUND OF THE INVENTION

The present invention relates to a centrifugal fan runner equipped with backward blades, and in particular relates to a cleaner fan of high efficiency, a large air volume and a low noise, an air conditioning apparatus, and an air blowing and ventilation fan.

A conventional centrifugal fan runner equipped with backward blades is described, for example, in Japanese Patent Laying-Open No. Hei 6-257595 (1994).

In the conventional centrifugal fan runner equipped with the backward blades, if a blade angle is increased for the purpose of increasing air volume to be blown out therewith, airflow collides upon a pressure surface of the blade at an inlet of the fan, thereby showing a tendency to increase noises. Also, a swirl portion of the airflow is increased at an outlet of the fan, thereby bringing about a phenomenon of reducing fan efficiency.

SUMMARY OF THE INVENTION

An object according to the present invention is, for dissolving the problem mentioned above, to provide a centrifugal fan runner, an air cleaner, and an outdoor machine of a fan, equipped with backward blades being able to increase an air volume to be blown out therewith, but without decreasing the fan efficiency thereof, even if an outer diameter thereof is almost same.

For achieving the object mentioned above, according to the present invention, there is provided a centrifugal fan runner, comprising:

a core plate being connected to an axis of a motor; and a side plate being provided opposing to said core plate, wherein backward blades, being inclined in an anti-rotational direction thereof, are provided at a distance in a circumferential direction, being characterized in that the backward blades are bent in a position at distance of about ½–1/(3.5) of a length of the blade from an outer periphery thereof, so that an outlet portion thereof is inclined into a direction of rotation of the blade, and an outlet angle of the outlet portion with respect to a tangential direction on an outer periphery of said side plate lies from about 40 degree to about 60 degree.

Also, according to the present invention, there is provided a centrifugal fan runner, as defined in the above, wherein further each of the backward blades is formed in a wing-like shape in an inlet portion thereof.

Also, according to the present invention, there is provided an air cleaner, comprising the centrifugal fan runner as defined in the above. Further, according to the present invention, there is also provided an air cleaner, comprising the centrifugal fan runner as defined in the above, wherein further a vane for collecting stationary pressure is provided on an outlet side of said centrifugal fan runner in a main body case thereof.

DETAILED DESCRIPTION OF THE PREFERRED EMBODIMENTS

Hereinafter, embodiments according to the present invention will be fully explained by referring to the attached drawings, FIGS. 1 through 8.

Figure 1:
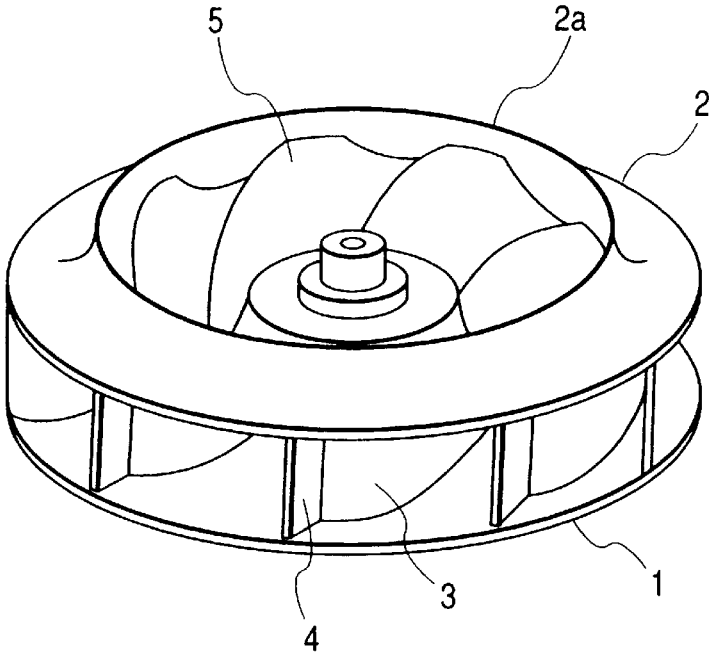
FIG. 1 is a view of showing the structure of an embodiment of a centrifugal fan runner, according to the present invention.

FIG. 1 is a view of showing the structure of an embodiment of a centrifugal fan runner equipped with backward blades, according to the present invention.

Figure 2:
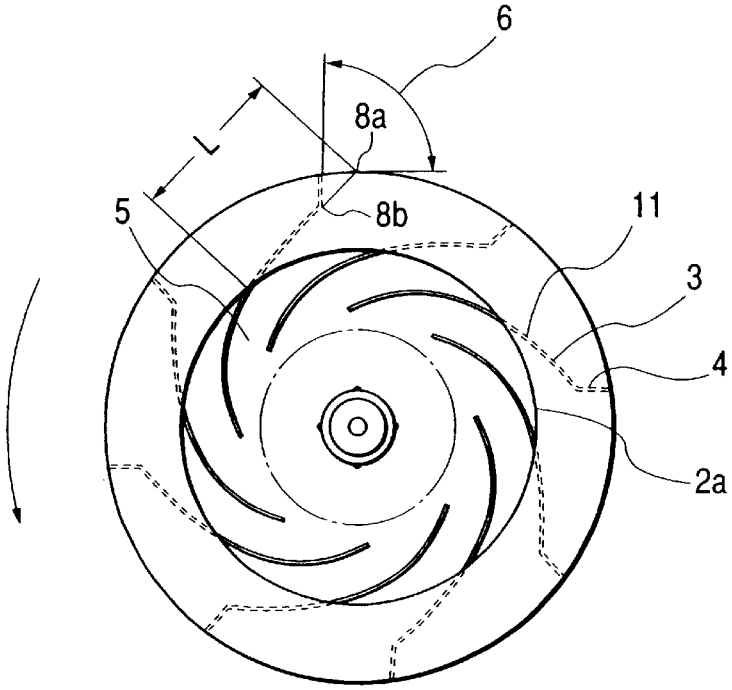
FIG. 2 is a brief upper plane view of showing a first embodiment of the centrifugal fan runner shown in the FIG. 1.
Figure 3:
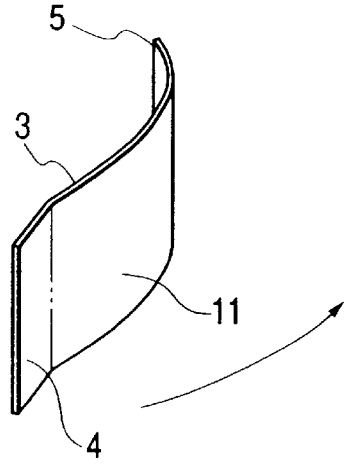
FIG. 3 is a brief perspective view of showing a backward blade in the first embodiment of the centrifugal fan runner, according to the present invention.

Explanation will be given on a first embodiment of the centrifugal fan runner according to the present invention, by referring to FIGS. 2 and 3. The FIG. 2 is an upper plane view of showing the first embodiment of the centrifugal fan runner shown in the FIG. 1, and the FIG. 3 is a perspective view of a backward blade in the first embodiment of the centrifugal fan runner according to the present invention.

Figure 7:
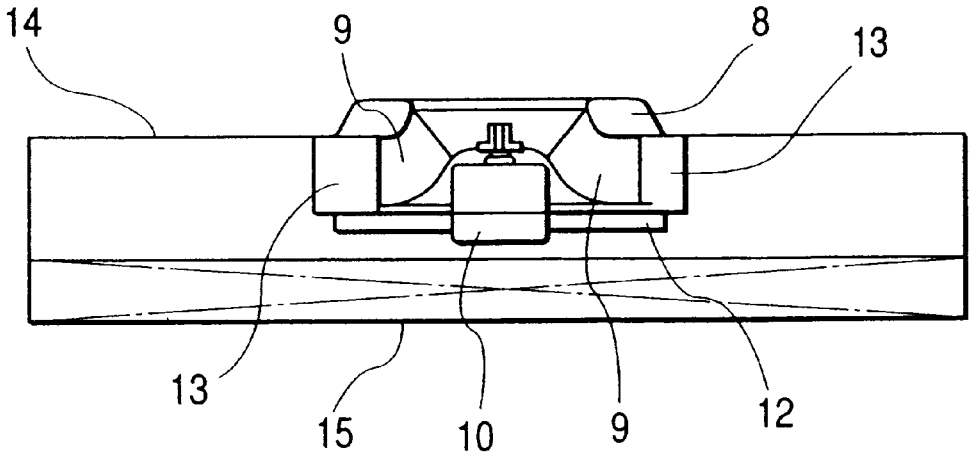
FIG. 7 is a cross-section view of showing the structure of an air cleaner according to a third embodiment of the present invention.

The centrifugal fan runner, according to the present invention, is connected to a motor axis, such as of a motor shown in FIG. 7, for example, and comprises a core plate 1, being formed from a material, such as, a metal plate, to be expanded so that the motor 10 can be installed therein, for example, and a side plate 2, being provided opposing to this core plate 1 and formed from the material of a metal plate to have a side plate opening portion 2*a*, wherein blades 3 are positioned between the above-mentioned core plate 1 and the side plate 2 at a constant distance on a circumferential direction thereof, while being inclined in an anti-rotational direction (or direction of reverse rotation) thereof. As is shown in the FIG. 3, the backward blades 3, each being formed with a plane surface or a smooth convex surface from such the material of a metal plate, for example, are provided in plural number. And, among of the core plate 1 and the side plate 2 and the plural number of blades 3 are formed airflow passages. When the centrifugal fan runner constructed in such the manner is rotated around, the airflow entering into from the side plate opening portion 2*a* is pushed out by blade pressure surfaces 11 of the backward blades 3, thereby obtaining a volume of an air to be blown out.

In the first embodiment according to the present invention, the backward blade 3 is shaped in such a form, that it is bended into the rotation direction of the fan in a position 8*b* at a distance of about ½–1/(3.5) of a length L of the blade from an intersection point 8*a* between a surface extended from a back pressure surface and an outer periphery of the side plate 2 (i.e., the length of a chain line portion from the outer periphery of the side plate 2 to an inner periphery thereof), and is inclined at an outlet angle of the blade from about 40 degree to about 60 degree with respect to a tangential line of the side plate 2 at an intersection point 4*a*.

Figure 9:
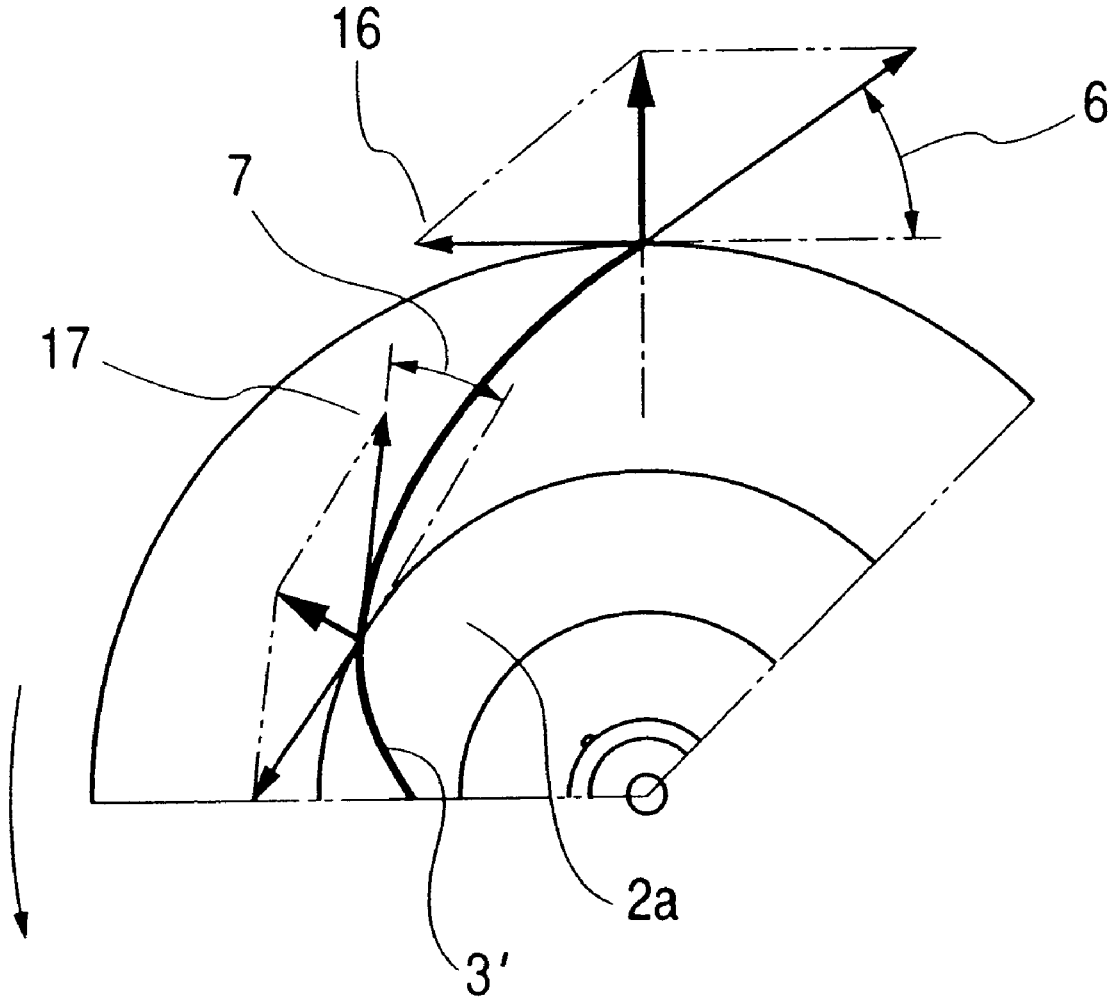
FIG. 9 is a view of showing the conventional centrifugal fan runner equipped with the backward blades.

By the way, for the purpose of increasing up the air volume to be blown out in the centrifugal fan runner having backward blades 3' according to the conventional art shown in FIG. 9, it is enough to increase a blade inlet angle 7 and a blade outlet angle 6. However, the shape of a blade inlet portion 5 mainly relates to noises of the fan, and a relative inflow velocity component (W1) 17 in an inflow velocity of the airflow at the blade inlet portion 5 is increased when the blade inlet angle 7 is increased, i.e., shows a tendency of increasing the noises (SL) as indicated by the following equation (Eq. 1) of relationship:

$$SL \alpha \ LOG_{10} \times W^{6}{}_{1} \qquad \text{(Eq.1)}$$

Also, the shape at the outlet of blade mainly relates to an efficiency of the fan runner, and a swirl outflow velocity component 16, being a loss component (or a kinetic pressure component) in the outflow velocity of the airflow at an outlet of the blade, is increased when the blade outlet angle 6 is increased. With this, a ratio of the kinetic pressure component rises up to a total pressure of the centrifugal fan runner, thereby bringing about a phenomenon that efficiency is decreased down.

However, according to the first embodiment mentioned above, it is possible to increase the air volume to be blown out, but without reducing the efficiency of the centrifugal fan runner, by bending backward blade 3 into the rotation direction of the fan in the position 8b at the distance of about ½–1/(3.5) of the length L of the blade from the intersection point 8*a* between the surface extended from the back pressure surface and the outer periphery of the side plate 2, and by bringing the blade outlet angle with respect to the tangential direction on the outer periphery of the side plate 2 at the outlet portion 4 of the blade 3 to be about from 40 degree to 60 degree.

By the way, on the backward blade 3, observing the condition of airflow upon the pressure surface 11 thereof, the flow velocity rises up abruptly at the inlet, while it gradually decelerated from the vicinity of a peak point of a convex surface of the backward fan 3 (in the vicinity of ½ of the length L of the blade), and under such the relationship as mentioned above, the flow velocity is decelerated abruptly if the position 8*b* where starting the increase in the outlet angle 6 of the blade is too far from the tip 8*a*, thereby giving an affect onto the noises. Therefore, the length from the intersection point 8*a* up to the position 8*b* is determined to be about ½ to 1/(3.5) of the length L of the blade. Also, if the outlet angle 6 is greater than about 60 degree at the outlet portion 4 of the blade 3, the swirl outflow velocity component 16, being the loss component (kinetic pressure component) in the outflow velocity of the airflow at the outlet of the blade, is increased, thereby reducing the efficiency, therefore the outlet angle 6 is determined to be around 60 degree or less than that.

Figure 4:
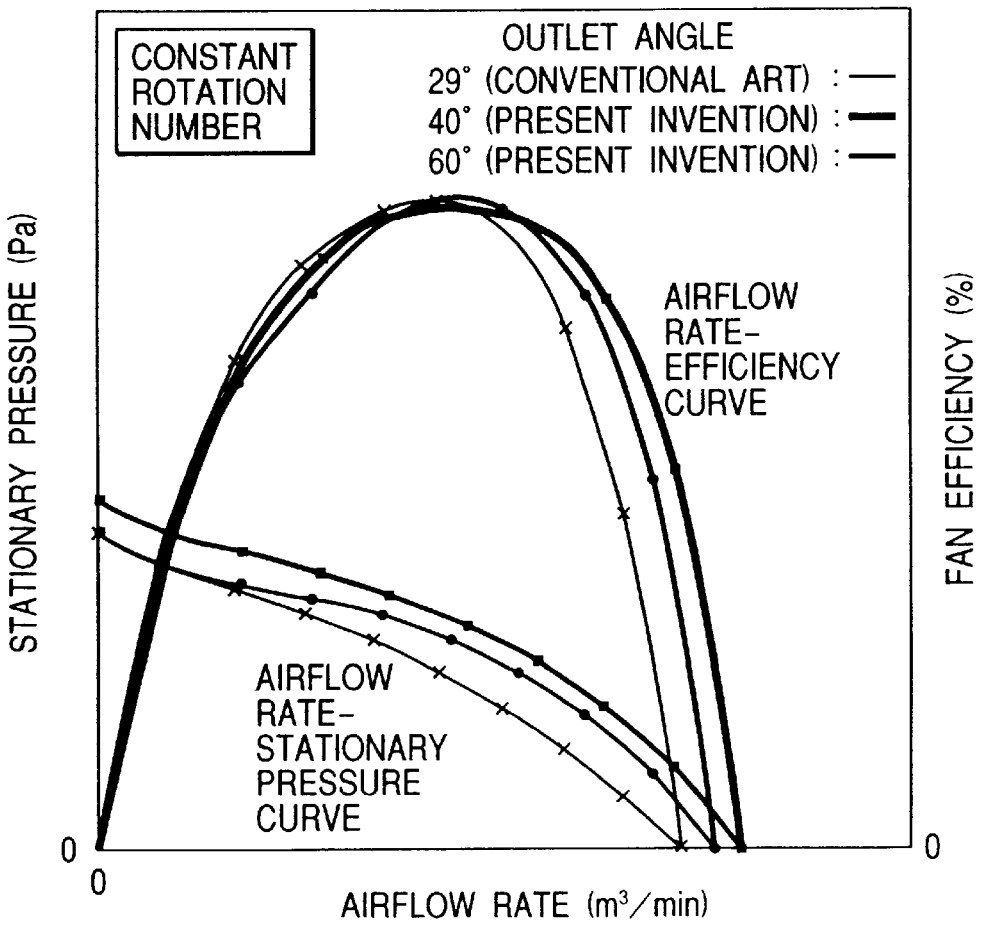
FIG. 4 is a graph for comparing the centrifugal fan runner according to the present invention to the conventional centrifugal fan runner shown in FIG. 9, in the characteristic curves of airflow rate-stationary pressure and airflow rate-efficiency.

FIG. 4 is a graph for comparing the centrifugal fan runner (the outlet angle is at 40 degree and at 60 degree) according to the present invention to the conventional centrifugal fan runner (the outlet angle is at 29 degree) shown in FIG. 9, in the characteristic curves between the airflow rate and the stationary pressure and between the airflow rate and the efficiency.

As is apparent from the FIG. 4, with the centrifugal fan runner according to the present invention, it is possible to increase the air volume to be blown out, while maintaining the efficiency of the centrifugal fan runner, by bending the backward bladed 3 into the rotational direction of the fan in the position 8*b* at distance of about ½–1/(3.5) of the length L of the blade and by bringing the outlet angle 6 at the outlet portion 4 thereof to be within a range from about 40 degree to about 60 degree, comparing to that of the conventional art.

Further, according to the centrifugal fan runner of the present invention, since it is possible to obtain the air volume much more, the revolution number thereof can be set lower, in a case of comparing it to the conventional centrifugal fan runner with the same air volume, thereby contributing to low noises of the centrifugal fan runner.

Figure 5:
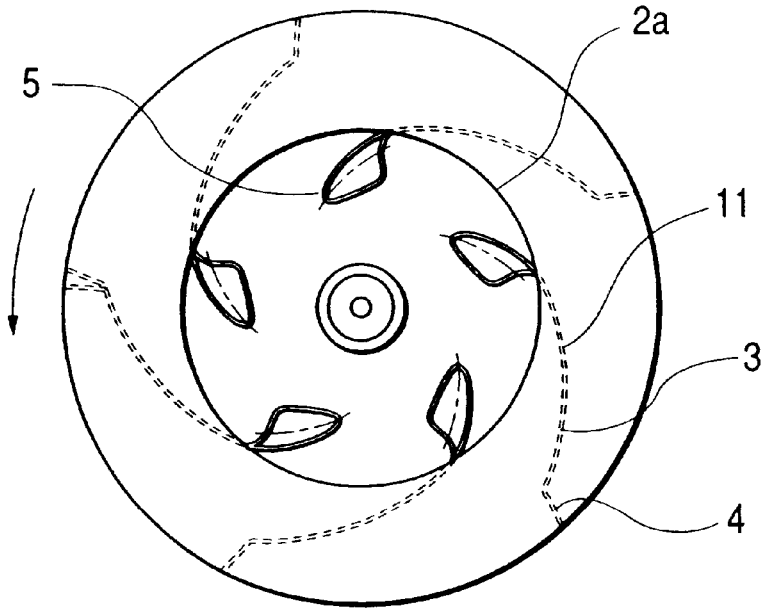
FIG. 5 is a brief upper plane view of showing a second embodiment of the centrifugal fan runner shown in the FIG. 1.
Figure 6:
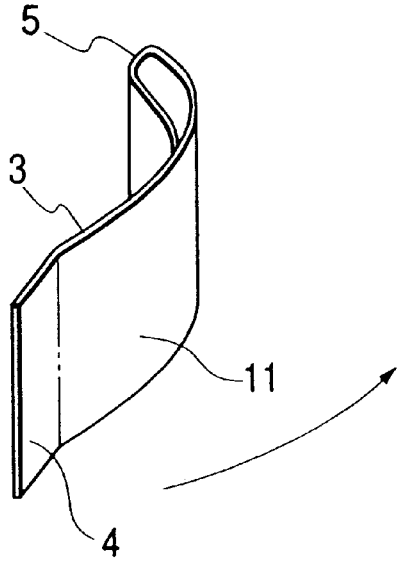
FIG. 6 is a brief perspective view of showing a backward blade in the second embodiment of the centrifugal fan runner, according to the present invention.

Next, explanation will be given on a second embodiment of the centrifugal fan runner according to the present invention, by referring to FIGS. 5 and 6. The FIG. 5 is an upper plane view of showing the second embodiment of the centrifugal fan runner shown in the FIG. 1; and the FIG. 6 is a perspective view of showing the backward blade in the second embodiment of the centrifugal fan runner, according to the present invention.

With the present second embodiment, in the backward blade 3 in the first embodiment, a tip portion of the blade at the inlet portion 5 thereof is formed, for example, from the metal plate material, and is bent, thereby forming it in a wing-like shape. In this manner, by forming a rear surface side in the wing-like shape at the inlet portion 5 of the blade 3, it is possible to run the airflow flowing in from the side plate opening 2*a* into the air passages of the centrifugal fan runner, without causing exfoliation therefrom.

As a result of this, it is possible to obtain prevention of the noises from being generated due to the exfoliation of the airflow, and further to realize the centrifugal fan runner obtaining the low noise in the first embodiment.

Figure 8:
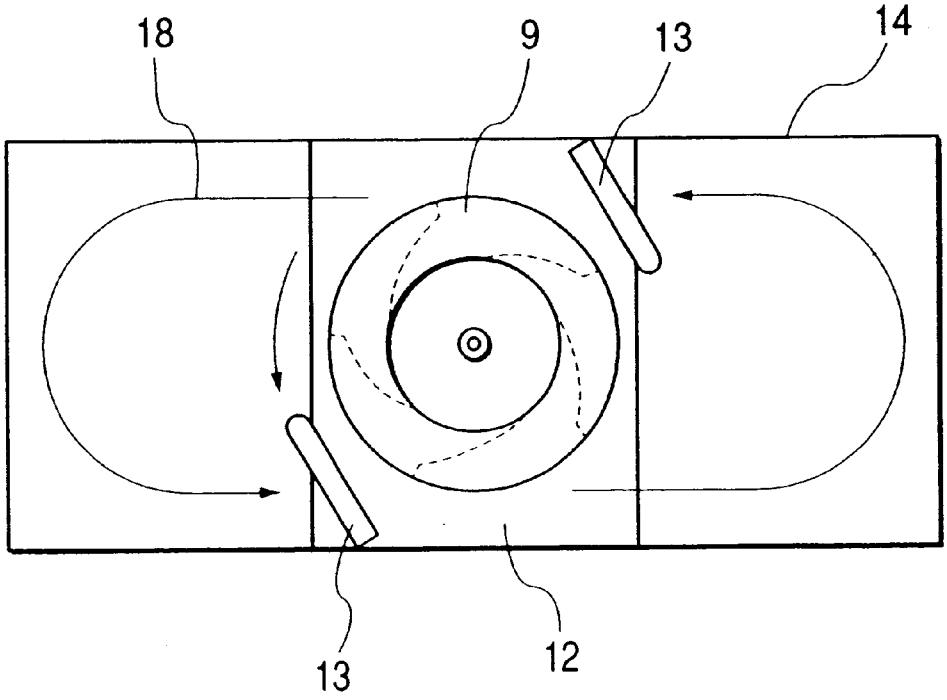
FIG. 8 is a vertical cross-section view of the structure shown in the FIG. 7.

Next, explanation will be given on a third embodiment of an air cleaner, which is equipped with the centrifugal fan runner according to the first or the second embodiment of the present invention, by referring to FIGS. 7 and 8. The FIG. 7 is a cross-section view of showing the structure of the air cleaner according to the third embodiment of the present invention; and the FIG. 8 is a vertical cross-section view of the structure shown in the FIG. 7.

The air cleaner of this third embodiment is constructed with the centrifugal fan runner 9 according to the first embodiment or the second embodiment, for generating the airflow therefrom, a motor 10 for rotating the centrifugal fan runner 9, a motor base 12 for fixedly mounting those centrifugal fan runner 9 and motor 10 thereon, a main body case 14 for storing those therein, and a filter 15 for cleaning the airflow blown out from the centrifugal fan runner 9. Further, on an upper surface of the main body case 14 is provided a bell mouth 8 for straightening the airflow sucked into.

Further, in the air cleaner mentioned above, vanes 13 for collecting stationary pressure, each tip of which is formed in a curved-surface in the shape thereof, are positioned vertically between the motor base 12 and the main body case 14, and at a constant distance from the outer periphery of the centrifugal fan runner 9. With the provision of the stationary pressure collector vanes 13, a swirl airflow 18, including the swirl outflow velocity component 16, being the loss component (kinetic pressure component) in the outflow velocity of the airflow at the outlet 4 of the blade of the centrifugal fan runner 9, is prevented by the stationary pressure collector vanes 13, thereby collecting the stationary pressure generated therein. With this, it is possible to increase the air volume to be blown out from the air conditioner, therefore it is possible to achieve the increase in the efficiency of the centrifugal fan runner 9.

Moreover, the centrifugal fan runners according to the first and the second embodiments mentioned above also can be applied into an outdoor machine of the fan, etc.

According to the present invention, it can be achieved to realize the centrifugal fan runner equipped with the backward blades for increasing the air volume to be blown out without the decrease in the fan efficiency.

Also, according to the present invention, also with the air cleaner, it is possible to increase the air volume with achieving the increase in the efficiency of the centrifugal fan runner thereof.

What is claimed is:

1. An air cleaner for cleaning ventilation air, comprising:

a main body case;

a centrifugal fan runner provided within said main body case;

a motor provided within said main body case for rotating said centrifugal fan runner;

a filter for cleaning air flow blown out from said centrifugal fan runner; and a stationary pressure collecting vane, being provided at an outlet side of said centrifugal fan runner, for collecting stationary pressure therein, wherein said centrifugal fan runner comprises:

a core plate being connected to an axis of said motor;

a side plate being provided opposing to said core plate; and backward blades being provided at a distance in a circumferential direction of said core plate, while being inclined in an anti-rotational direction thereof, wherein said backward blades are bent on a position at a distance of about ½–1/(3.5) of length of each of said blades from an outer periphery thereof, so that an outlet portion thereof is inclined into a direction of rotation of said blade, and an outlet angle of the outlet portion with respect to a tangential direction on an outer periphery of said side plate lies from about 40 degrees to about 60 degrees.

2. An air cleaner as defined in the claim 1, wherein further each of said backward blades is formed in a wing-like shape in an inlet portion thereof.

3. An air cleaner as defined by claim 1, wherein said filter is provided in said main body cases.

* * * * *